US006067365A

United States Patent [19]

Morenz

[11] Patent Number: 6,067,365

[45] Date of Patent: May 23, 2000

[54] LOUDSPEAKER

[76] Inventor: Paul Morenz, 2790 Loker Ave., W. Suite 105, Carlsbad, Calif. 92008-6613

[21] Appl. No.: 09/160,853

[22] Filed: Sep. 25, 1998

[51] Int. Cl.[7] ..... H04R 25/00

[52] U.S. Cl. ..... 381/412; 381/400; 381/396

[58] Field of Search ..... 381/412, 413, 381/392, 354, FOR 159, 396, 400, 409, 410, 420, 421, 422, FOR 154; 181/199

[56] References Cited

FOREIGN PATENT DOCUMENTS 000486254 5/1992 European Pat. Off. ..... 381/FOR 159

*Primary Examiner*—Huyen Le

*Attorney, Agent, or Firm*—Frank D. Gilliam

[57] ABSTRACT

A speaker has electrical insulation between the voltage found on the voice coil and the exposed support frame. The insulation can be in the form of a toroid, a washer or a plurality of spacers with opening therebetween spaced so as to maintain electrical separation between the frame and magnet/pole piece.

5 Claims, 2 Drawing Sheets

LOUDSPEAKER

FIELD OF THE INVENTION

The field of this invention relates generally to transducers and particularly to loud speakers, powered woofers, drivers for vibration tables, shakers and other applications where acoustic or vibratory power is required.

BACKGROUND OF THE INVENTION

Drawing FIG. 1 depicts a typical prior art transducer in the form of a loudspeaker. The speaker has a magnet and a pole piece and a metal speaker frame or basket. The metal frame is connected directly to the magnet and pole piece via a metal top plate thereby creating an electrical conduction between the metal frame and magnet and pole piece.

An enlarged slot is provided between the upper portion of the combined pole piece and magnet providing a close tolerance co-axial space for movement of a voice coil and its support form within the slot. Voltage often in the range of 240 volts AC or more is present on the windings of a voice coil depending on amplifier construction.

A typical rather stiff speaker cone is fixedly secured at its widest circumference to a flexible suspension member which is fixedly attached at its smallest end to the voice coil form and spider.

The problem occurring with this configuration is that an off center voice coil position can cause the windings of the voice coil to rub against the magnet or pole piece wearing off the insulation on the coil wires and shorting the line voltage on the coil to the magnet and pole piece and hence to the metal frame surrounding the speaker cone. Obviously, this places line voltage where it can come in contact with a person touching the metal frame of the speaker and can be lethal if that person should simultaneously come in contact with ground potential.

It would be of great advantage to eliminate this potential hazard by providing an inexpensive way to isolate the high voltage from the speaker frame in the event of a short circuit of the voice coil winding to the metal frame.

There has not been a satisfactory economically inexpensive means or method to isolate the high voltage from becoming a potential hazard in the absence of an isolation transformer until the present invention.

SUMMARY OF THE INVENTION

The invention is generally directed to powered sub woofers. However, the theory defined and claimed herein can be equally directed to high power transducers used for various industrial uses such as, but not limited to shakers, vibration tables, or any other applications where acoustic or vibratory power is required.

The invention is directed to the placement of insulation material between the magnet and/or pole piece and the outer speaker metal frame.

Generally the speaker frame is physically attached directly to the magnet and pole piece assembly. This direct connection provides a common electrical potential between the various metal parts of the speaker assembly. The danger of this construction is the potential of the voice coil with the high voltage thereon shorting against the magnet or pole piece causing the high line voltage to be present on the metal speaker frame which is exposed. Obviously, if a person should become in contact with the speaker frame and ground potential serious injury or death could occur.

The present invention eliminates this potential hazard by insulating the exposed frame from the magnet and pole piece thereby preventing any voltage on the voice coil from being present on the exposed frame regardless of shorting between the voice coil windings and the magnet or pole piece.

The principle object of this invention is to eliminate the possibility of causing severe personal injury or death caused by a person coming in contact with a speaker exposed frame and ground potential.

Another object of this invention is to provide a speaker assembly that doe snot utilize an isolation transformer and yet removes the possibility of severely injuring or electrocution of a person coming in contact with the exposed metal of a speaker frame and ground potential when a short has occurred placing line voltage on the magnet and/or pole piece.

These and other aspects and advantages of the invention will become more apparent to the person of ordinary skill in the art upon review of the following detailed description taken in conjunction with the appended drawings in which like reference numerals designate like items.

DETAILED DESCRIPTION OF THE PREFERRED EMBODIMENT

Figure 1:
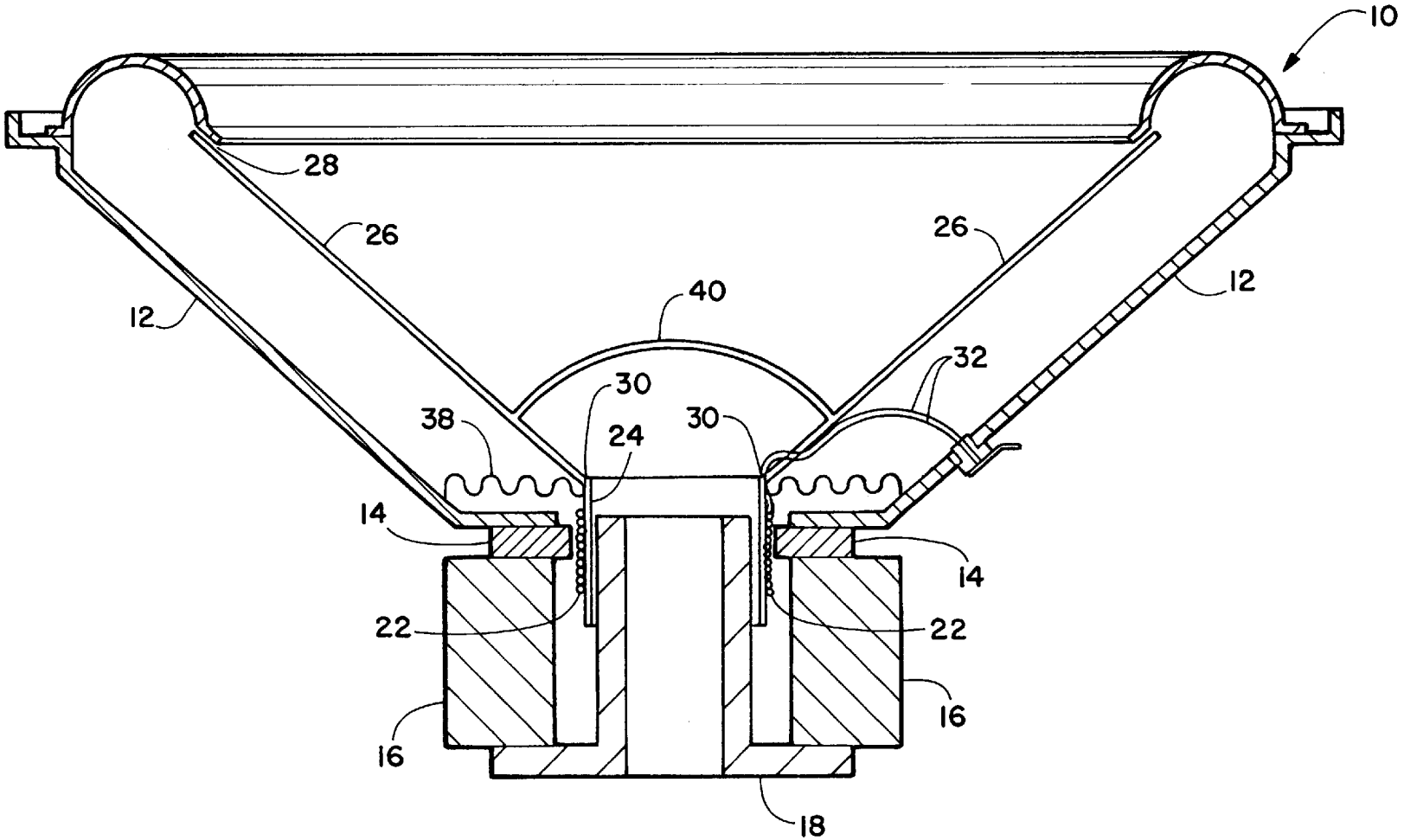
PRIOR ART FIGURE 1
FIG. 1 is a cutaway showing of a conventional prior art speaker having a direct physical and electrical connection between the magnet, pole piece and exposed speaker frame.

Referring now specifically to the prior art drawing FIG. 1, a cutaway showing of a conventional speaker 10 is shown. The speaker comprises a speaker exposed frame 12 attached through a top metal plate pole piece 14 to a magnet 16 which includes a second pole piece 18. The connection is generally made by bolting or riveting the various metal components together.

A close tolerance gap 20 is provided between the top metal plate 14 and the pole piece 18. Within the gap 20 is positioned a voice coil 22 would around and attached to a rigid form 24.

A speaker cone 26 is attached to the exposed metal frame at top 28 and is attached to the voice coil form at lower end 30.

A pair of wires 32 provide voltage to the voice coil windings. From an amplifier or other power source.

A spider 38 is connected between the bottom of the cone, coil form and exposed housing 12.

A dust cap 40 conveniently prevents dust and other debris from entering the close tolerance slot 20.

Figures 2, 3:
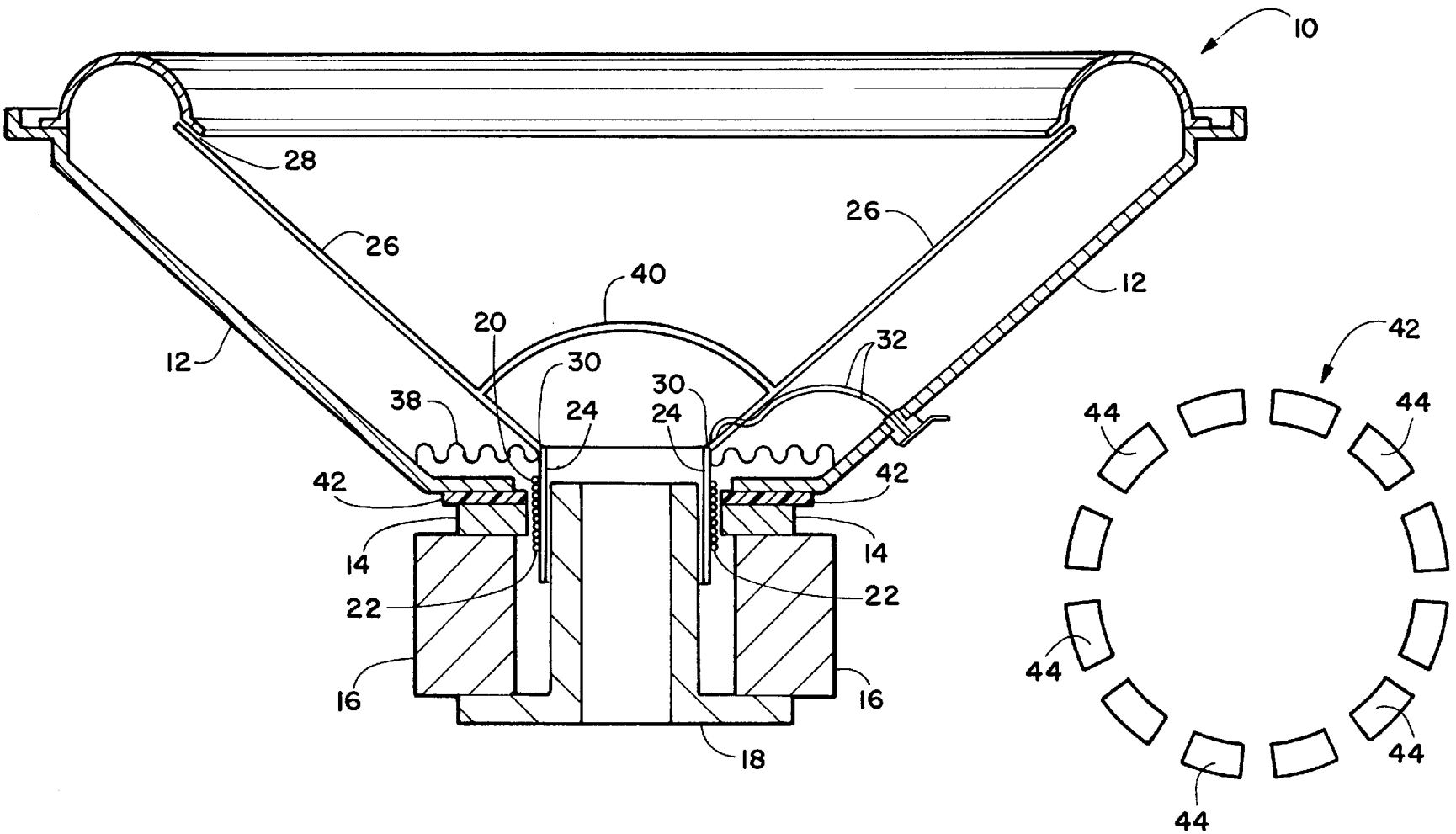
FIG. 2 is a cutaway showing of a conventional speaker similar to drawing FIG. 1 having electrical insulation positioned between the exposed speaker frame and magnet and pole piece.
FIG. 3 is a plan view showing of spaced apart segmented insulation spacers.

Referring now specifically to drawing FIG. 2, this cutaway showing of a conventional speaker is the same as shown in drawing FIG. 1 except that the insulation is provided between the power source on the voice coil windings and the exposed frame 12.

The voice coil windings now have voltage thereon, but this voltage cannot now be transferred from the voice coil to the exposed speaker frame as an insulator 42 is placed between the top plate and the combined magnet and pole piece.

The insulator 42 may have the general shape of a doughnut, toroid or washer and has suitable thickness depending on the voltage insulation required.

The insulator 42 may also be a plurality of spaced apart curvilinear segments 44 positioned around the periphery of the top plate (see FIG. 3) and the exposed speaker frame leaving air gaps between the segments.

Any good insulation material may be utilized that is suitable for the purpose intended. By way of example and not as limiting in any way suitable material such as plastics, hard rubber, wood, phenolic or the like may be used.

The attachment of the frame, insulation material and magnet/pole piece can be adhesive bonded, connected with non-electrical conducting screws or any other connection means that prevents an electrical connection therebetween.

While the foregoing constitutes the preferred embodiment of the present invention, it is to be understood that the invention is not limited thereby and that in light of the present disclosure, various alternative embodiments will be apparent to persons skilled in the art. Accordingly, it is to be recognized that changes can be made without departing from the scope of the invention as particularly pointed out and distinctly claimed in the claims set forth below all legal equivalents thereof.

What is claimed is:

1. An improved loud speaker comprising:

a magnet means having a pole piece with an elongated cylindrical slot having sidewalls between a portion thereof;

an electrical insulation spacer;

a support frame having a first wide opening and a narrow second opening positioned opposite thereto, said insulation spacer positioned between said magnet means and said narrow opening of said support frame for providing high voltage electrical insulation therebetween; and a voice coil centered in said elongated clindrical slot for movement parallel to said sidewalls thereof, said voice coil supported by a cylindrical form, said voice coil being energized with a high voltage, said voice coil and form being positioned in close tolerance within said cylindrical slot between said pole piece and said magnet for parallel relative movement thereto;

a speaker cone positioned within said support frame fixedly connected to and centering said voice coil and form at said second narrow opening and fixedly connected to said frame at said first wide opening.

2. The invention as defined in claim 1 wherein said insulation spacer is in the form of a washer.

3. The invention as defined in claim 1 wherein said insulation spacer is in the form of a plurality of spaced apart segments with air gaps therebetween.

4. The invention as defined in claim 1 wherein said insulation spacer is adhesively bonded to said support frame and said pole piece.

5. The invention as defined in claim 1 wherein said insulation spacer is connected to said support frame and said pole piece by non-electrical conductive connectors.

* * * * *